US005144271A

United States Patent [19]

Schedele

[11] Patent Number: 5,144,271

[45] Date of Patent: Sep. 1, 1992

[54] ELECTROMAGNETIC POWER RELAY

[75] Inventor: Helmut Schedele, Diessen, Fed. Rep. of Germany

[73] Assignee: Siemens Aktiengesellschaft, Munich, Fed. Rep. of Germany

[21] Appl. No.: 725,643

[22] Filed: Jul. 3, 1991

[30] Foreign Application Priority Data

Sep. 18, 1990 [DE] Fed. Rep. of Germany ... 9013223[U]

[51] Int. Cl.[5] ..... H01H 51/22

[52] U.S. Cl. ..... 335/83; 335/128; 335/202

[58] Field of Search ..... 335/78-85, 335/124, 128, 131, 132, 202

[56] References Cited

U.S. PATENT DOCUMENTS 4,602,230 7/1986 Schedele .
4,837,538 6/1989 Dittmann ..... 335/202
5,038,122 8/1991 Nakayama et al. ..... 335/78

*Primary Examiner*—Lincoln Donovan
*Attorney, Agent, or Firm*—Hill Van Santen, Steadman & Simpson

[57] ABSTRACT

In an electromagnetic power relay, a spring carrier and a cooperating contact element are plugged into slots in a base member from two opposite sides. Terminal rails extending parallel along the outside walls of the base member to an end face of the relay have, at the end face, portions which are crimped inwardly within pockets in the housing cap. The terminal elements then emerge from the outside walls of the relay at a predetermined insulating distance from the side walls of the relay and form solder and plug terminals. Within the pockets, the terminal elements are provided with fastening projections for anchoring, the fastening projections lying in the inwardly offset planes of the terminal elements. An adequate insulating distance from the side walls of the relay is, thus, provided so that the relays may be tightly grouped on a printed circuit board.

2 Claims, 1 Drawing Sheet

ELECTROMAGNETIC POWER RELAY

BACKGROUND OF THE INVENTION

1. Field of the Invention

The present invention is related generally to an electromagnetic power relay and, more particularly, to a power relay having a magnetic system and a set of contacts on a contact spring and a cooperating contact element, respectively, which are plugged into receptacle slots in the base of a relay housing and from which terminal rails extend to provide electrical connections to the contacts.

2. Description of the Related Art

A relay is disclosed in European published application 0 147 681 B1. This known relay includes solder and plug terminals situated as a straight extensions of the terminal rails which are linked to the contacts so that the terminals lie in planes along the outside surfaces of the housing. It is not possible to mount such a relay on to a printed circuit board directly next to an identical relay or to some other equipment having open metal parts, since the terminals of the relays would be too close to one another and the required insulating distances, including the air and creepage paths, required for high current terminals is not sufficient.

Although it is also known in relays t displace similar terminal rails which have solder and plug terminals applied to the rail extensions at the end face of the relay closer together an away from the outside walls of housing from the very outset, it is then not possible to utilize the entire relay width for the width of the contact elements. This leads either to an enlargement of the overall width of the relay to compensate for the relatively narrower contact elements, or to a reduced cross section of the contact elements and therefore a lower current carrying capacity. It is precisely in high current relays in which optimally small dimensions are a critical matter, that it is important to use the entire relay width for the dimensions of the contact elements.

It has been proposed to crimp the terminal rails at a location outside of the housing at the end face of the relay. In this case, too, the required insulating distance from the outside edge of the housing for mounting the relays adjacent one another is not established at the portion of the rail before the crimped portion.

SUMMARY OF THE INVENTION

It is an object of the present invention to utilize the full housing width of a relay for the width of the contact elements while still insuring that the parts of the terminal rails that extend outside the housing have an adequate insulating distance from the outside walls of the housing for convenient mounting of the relay adjacent other parts. Moreover, the invention provides optimal anchoring of the contact terminal elements in the base member of the relay so that the adjustment of the contact elements relative to one another is not changed during plugging or removing of cable terminals from the terminal rails.

These and other objects and advantages of the invention are achieved in a relay including:

in the region of the end face of the relay, the terminal rails are crimped inwardly and thus the two end sections of terminal rails are spaced from the relative planes of the outside surfaces of the housing along which the terminal rails extend internally;

pockets are applied to the cap portion of the relay housing outside the end face of the relay, the pockets accept the crimped sections of the terminal rails and, in a preferred embodiment are, open from the bottom to the top; and fastening projections extend from the terminal rails in the region of the pockets, the fastening projections preferably being partially cut free of the terminal rails and lying in the respective planes of the inwardly offset end sections of the terminals rails, the fastening projections are anchored in the region of the top side opening of the respective pocket.

These features are provided in a relay having a magnetic system and a set of contacts on a contact spring and a cooperating contact element arranged in the housing that is composed of a base member of an insulating material and of a cap, the contact spring and the cooperating contact element being secured in an upright position substantially parallel to one another and essentially perpendicular to the bottom side of the relay. The cooperating contact element and a spring carrier which holds the contact spring are plugged into receptacle slots in the base member from the outside in two opposite directions. The cooperating contact element and the spring carrier each have a terminal rail which extends along the respective outsides of the base member between the base member and the cap up to and through the end face of the relay. The parallel terminal rails emerge from the housing at the relay end face and each form downwardly directed solder terminals as well as upwardly directed plug terminals.

For anchoring the terminal rails, the fastening projections are bent inward over a shoulder inside the pockets. These fastening projections are easily accessible to a tool through an appropriate recess at the outside of the pockets.

Due to the inventive crimping of the terminal rails inside the pockets at the end face of the housing cap, it is guaranteed that all portions of the terminal rails which lie in the planes of the housing side walls are inside the housing and further that the overall relay width is available for the cross sectional dimensioning of the contact elements for carrying high currents. At the same time, however, it is also guaranteed that all terminal part lying outside the housing have an adequately large insulating distance from the outside contour of the housing from the very start so that the relay can be arranged tightly packed with other relays or components on a printed circuit board. The anchoring of the terminal rails in the pockets also ensues through the fastening projections which already lie in the inwardly disposed plane of the end sections so that the fastening projections which, of course, must be accessible from the outside for assembly of the housing cap, also have the required insulating distance from the side walls.

BRIEF DESCRIPTION OF THE DRAWINGS

The present invention shall be set forth in greater detail below with reference to an exemplary embodiment shown in the drawings wherein.

DETAILED DESCRIPTION OF THE PREFERRED EMBODIMENTS

Figure 2:
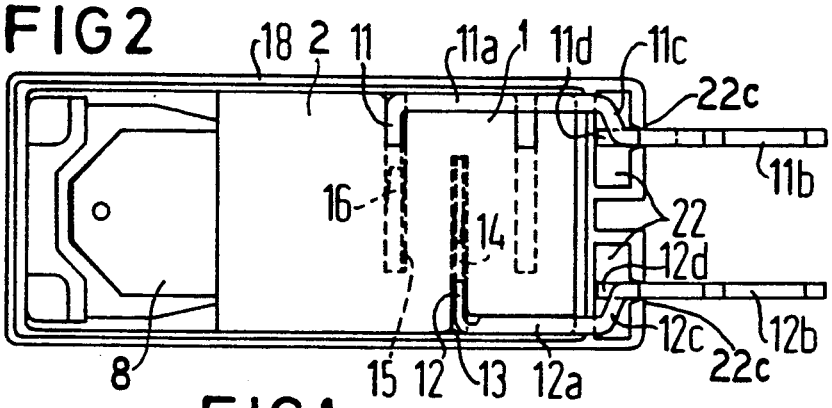
FIG. 2 is a bottom view of the relay of FIG. 1 with the bottom plate removed.
Figure 1:
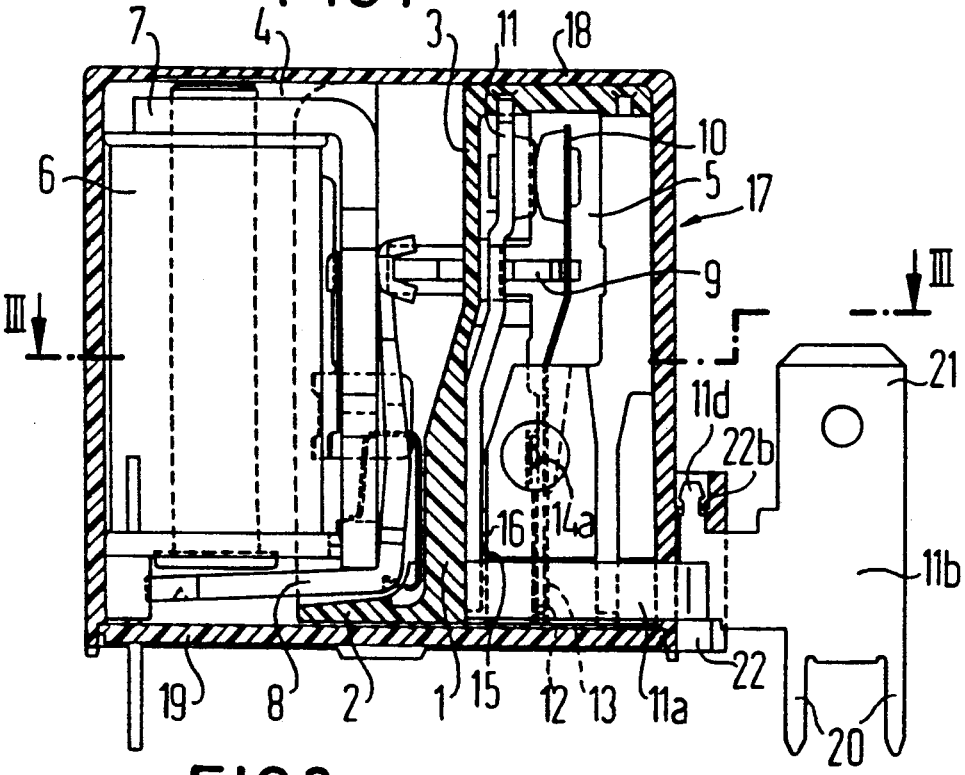
FIG. 1 is a side elevational view, partially in cross section, of a relay according to the principles of the present invention.
Figure 3:
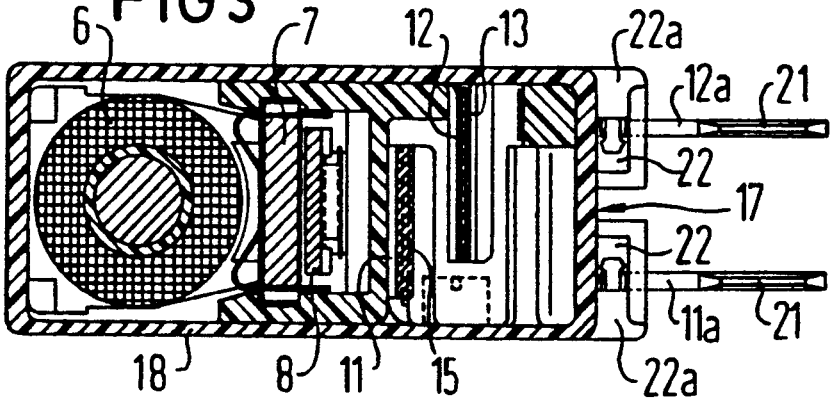
FIG. 3 is a cross section along the line III-III of the relay shown in FIG. 1.

A relay according to the present invention is shown in FIGS. 1 through 3, including a base member 1 with a floor part 2 and an essentially perpendicular partition 3 with which a magnetic system space 4 is separated from a contact space 5. The magnetic system includes a coil 6, a yoke 7, and an armature 8 whose switch motion is transmitted to a contact spring 10 via a slide 9. The contact spring 10 in turn cooperates with a stationary cooperating contact element 11. The illustrated example shows a break-contact relay; although, of course, a make-contact relay may also be formed via a different arrangement of the cooperating contact element.

The contact spring 10 is held by a spring carrier 12 which is plugged into a receptacle slot 13 in the base member 1 proceeding from the outside. The spring carrier 12 is held in place with a tab 14 and additionally anchored by staggering a male fastening member 14*a*. The cooperating contact element 11 is plugged into a corresponding receptacle slot 15 in the base member 1 and is also anchored with a tab 16. As may be seen in FIG. 2, the spring carrier 12 and the cooperating contact element 11 are plugged into the base 1 from the side, each being plugged from opposite sides. The contact spring 1 and the cooperating contact element 11 thus essentially are perpendicular to the floor of the base member 1 and proceed approximately parallel to one another with the contacting regions overlapping one another. Insofar as the mutual distance from the terminal parts permit, the contact spring 10 and the cooperating contact element 11 each extend over a large portion of the width of the relay. These parts, thus, have a relatively large cross section for carrying high currents.

The spring carrier 12 and the cooperating contact element 11 each merge into a terminal rail 12*a* or 11*a*, respectively, in the region of the floor 3 of the base member 1. These terminal rails 12*a* and 11*a* extend along the opposite outside walls of the base member 1 in the direction toward the end face 17 of the relay. The terminal rails thus proceed between the base member 1 and the side walls of a cap 18 which, together with the base member 1, forms the housing for the relay. For sealing purposes, moreover, an additional cover plate 19 is provided on the underside of the relay.

In the region of the end face 17, the terminal rail 11*a* for the cooperating contact element 11 and the terminal rail 12*a* for the spring carrier 12 are crimped inwardly relative to the side walls of the relay and then crimped again to form parallel terminal end sections 11*b* and 12*b*, respectively. Solder pins 20 extend in a downwardly direction and flat plugs 21 extend in an upwardly direction at the terminal end sections 11*b* and 12*b*. Bent sections 11*c* and 12*c*, respectively, lie in pockets 22 applied to the cap 18 at the end face 17. The pockets 22 are open in a downward direction and in an upward direction with an intermediate wall and include slots 22*c* in the circumferential walls proceeding from below. The terminal rails 11*a* and 12*a* enter these slots 22*c* when the cap 18 is plugged on to the relay during assembly.

In the region of the pockets 22, the terminal rails 11*b* and 12*a* also have fastening projections 11*d* and 12*d* which are cut free from the bent regions 11*c* and 12*c*, respectively, and which lie in the planes of the end sections 11*b* and 12*b*, respectively. In other words, the fastening projections 11*d* and 12*d* extend in the planes of the end sections 11*b* and 12*b* even though the bent sections 11*c* and 12*c* lying therebelow are outside these planes. By providing appropriate wall recesses 22*a*, the upwardly projecting fastening projections 11*d* and 12*d* are accessible for tools proceeding from the outside, i.e. laterally, and thus the upwardly extending projections 11*d* as shown in FIG. 1 may be bent inward over a shoulder 22*b* of the respective pocket as shown in FIG. 3 after the cap 18 is plugged on to the base 1. As a result thereof, the terminal rails 11*a* and 12*a* are securely anchored in the relay. As a result of being applied in the plane of the end sections 11*b* and 12*b*, the outwardly accessible fastening projections 11*d* and 12*d* also lie at an insulating distance from the outside of the housing so that the required air and creepage paths to any neighboring components are always guaranteed.

Thus, there is shown and described an electromagnetic power relay having a spring carrier and a cooperating contact element which are plugged into slots of a base member from two opposite sides, and which have terminal rails conducted parallel along the outside walls of the base to an end face. At the end face, the terminal elements are crimped within pockets on the housing cap and emerge from the end face at a prescribed insulating distance from the outside walls of the relay. The portions of the terminal rails which lie outside the housing have end sections having solder and plug terminals. The terminal elements are anchored within the pockets with applied fastening projections. The fastening projections lie in inwardly offset planes relative to the sides of the housing. The solder and plug terminals are, thus, arranged at an adequate insulating distance from the side walls of the relay so that a close mounting arrangement of the relays on a printed circuit board is possible.

Although other modifications and changes may be suggested by those skilled in the art, it is the intention of the inventor to embody within the patent warranted hereon all changes and modifications as reasonably and properly come within the scope of my contribution to the art.

I claim:

1. An electromagnetic power relay, comprising:

a housing having:

a base member of an insulating material defining a contact space and a magnetic system space, said base member defining receptacle slots extending, from the outside in two opposite directions, and a cap mounted over said base member to substantially enclose the relay therewithin;

a magnetic system mounted in said magnetic system space of said housing;

a spring carrier plugged into one of said receptacle slots in said base member;

a set of contacts including a contact spring and a cooperating contact element in said contact space of said housing, said contact spring and said cooperating contact element being secured generally parallel to one another and generally perpendicular relative to a bottom side of said housing, said cooperating contact element being plugged into one of said receptacle slots in said base member, said contact spring being fastened to said spring carrier;

a first terminal rail electrically connected to said contact spring and extending along an outside of said contact space between said base member and said cap to an end face of said housing, said first terminal rail having an end section extending beyond the end face of said housing;

a second terminal rail electrically connected to said cooperating contact element and extending along an outside of said contact space between said base member and said cap to the end face of said housing, said second terminal rail having an end section extending beyond the end face of said housing, said second terminal rail being substantially parallel to s id first terminal rail;

downwardly directed solder terminals and upwardly directed plug terminals formed on said end sections of each of said first and second terminal rails;

said first and second terminal rails each being crimped inwardly toward one another at bend regions adjacent the end face of said housing so that said end sections of each of said first and second terminals are at an insulating distance from respective planes of opposite outside surfaces of said housing;

pockets on said cap at the end face of said housing, said bend regions of said first and second terminal rails being contained within said pockets, said pockets having openings from the top and openings from the bottom; and fastening projections extending from inwardly offset portions of said end sections of said terminal rails in a region of said pockets, said fastening projections being anchored in said pockets.

2. An electromagnetic power relay as claimed in claim 1, wherein said pockets each have shoulders and said fastening projections are bent over said shoulders.

* * * * *